US010468792B2

(12) United States Patent
Yamamoto

(10) Patent No.: US 10,468,792 B2
(45) Date of Patent: Nov. 5, 2019

(54) TERMINAL BLOCK

(71) Applicant: YAZAKI CORPORATION, Tokyo (JP)

(72) Inventor: Hirotaka Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/980,463

(22) Filed: May 15, 2018

(65) Prior Publication Data

US 2018/0337471 A1 Nov. 22, 2018

(30) Foreign Application Priority Data

May 16, 2017 (JP) ..... 2017-097000

(51) Int. Cl.
*H01R 9/24* (2006.01)
*H01R 11/12* (2006.01)

(52) U.S. Cl.
CPC ..... *H01R 9/2416* (2013.01); *H01R 11/12* (2013.01)

(58) Field of Classification Search
CPC ..... H01R 9/24
USPC ..... 439/883, 709
See application file for complete search history.

(56) References Cited

U.S. PATENT DOCUMENTS 1,659,303 A * 2/1928 Rovere ..... H01R 9/223 174/59
3,090,936 A * 5/1963 Maitby ..... H01R 9/2416 439/595
4,195,194 A * 3/1980 Kuster ..... H01R 4/2462 174/59
4,210,379 A * 7/1980 Vachhani ..... H01R 9/2408 439/406
4,236,778 A * 12/1980 Hughes ..... H01R 9/24 439/406
4,343,529 A * 8/1982 Reavis, Jr. ..... H01R 4/2441 439/406

(Continued)

FOREIGN PATENT DOCUMENTS

CN 104124563 A 10/2014
JP 2006-196348 A 7/2006
JP 2014-99287 A 5/2014

OTHER PUBLICATIONS

Chinese Office Action for the related Chinese patent application No. 201810468886.0 dated May 21, 2019.

(Continued)

*Primary Examiner* — Neil Abrams
(74) *Attorney, Agent, or Firm* — Kenealy Vaidya LLP

(57) ABSTRACT

A terminal block including a partition walls with curved edges. The partition walls with curved edges is erected between a plurality of terminals to separate the adjacent terminals to insulate. The partition walls with curved edges. The partition walls with curved edges includes an upper end surface and both side surfaces. Each of the both side surfaces includes a taper surface tilted downward and continuous to the upper end surface, and a vertical surface which is continuous to a lower side of the taper surface and positions a connection counterpart terminal to be connected with one of the plurality of terminal at a position of connection with the terminal. The partition walls with curved edges serve to guide the counterpart terminals into position for attachment to terminals of the block.

4 Claims, 7 Drawing Sheets

(56) References Cited

U.S. PATENT DOCUMENTS 4,972,576 A * 11/1990 Sloppy ..... H01R 9/24 29/884
5,203,724 A * 4/1993 Casey ..... H01R 9/24 439/521
5,215,480 A * 6/1993 Lesslie ..... H01H 71/08 361/730
6,283,765 B1 * 9/2001 Lumbis ..... B60T 13/665 439/35
6,464,538 B2 * 10/2002 Miyazaki ..... H01R 13/6589 439/607.44
6,663,443 B1 * 12/2003 Smith ..... H01R 4/36 439/810
7,527,523 B2 * 5/2009 Yohn ..... H01R 4/30 439/564
7,811,116 B2 * 10/2010 Sakakura ..... H01R 4/302 439/364
8,226,446 B2 * 7/2012 Kondo ..... H01R 4/34 439/488
8,622,772 B2 * 1/2014 Akuta ..... H01R 13/405 439/722
2001/0024911 A1 * 9/2001 Bre' ..... H01R 9/24 439/717
2006/0160420 A1 7/2006 Takahashi
2013/0092412 A1 * 4/2013 Tanaka ..... H01R 13/6592 174/78
2014/0134897 A1 5/2014 Akuta
2014/0322973 A1 * 10/2014 Okamoto ..... H01R 13/4223 439/587
2018/0337471 A1 * 11/2018 Yamamoto ..... H01R 9/2416

OTHER PUBLICATIONS

French Office Action for the related French patent application No. 18 54033 dated Oct. 17, 2018.

* cited by examiner

TERMINAL BLOCK

CROSS REFERENCE TO RELATED APPLICATIONS

This application claims priority from Japanese Patent Application No. 2017-097000 filed on May 16, 2017, the entire contents of which are incorporated herein by reference.

BACKGROUND OF THE INVENTION

Field of the Invention

The invention relates to a terminal block in which a plurality of terminals are horizontally arranged between insulation partition walls.

Description of Related Art

In the related art, a terminal block is formed such that a plurality of terminals are horizontally arranged between insulation partition walls.

In a terminal block in which a plurality of terminal parts arranged on an insulating base are provided and a partition wall protrudes from an upper base between adjacent terminal parts, a terminal block in which a terminal identification number indicating an arrangement order from an end of a base is allocated with respect to the terminal part and an identifier indicating the allocated terminal identification number is provided in a predetermined position of the partition wall (see, for example, the patent document 1: JP-A-2012-33380).

[Patent Document 1] JP-A-2006-196348

According to a related art, a terminal block, in a case where connection counterpart terminals attached in terminal parts of a plurality of wires held in a housing of a connector are connected with respective terminals of a terminal block, a wire portion near each of the connection counterpart terminals is movable freely. Thus, when the connector is moved toward the terminal block for connection, the terminal is ridden on the upper end surface of a partition wall, and the connection operation between the connection counterpart terminal and the terminal becomes complicated, which is a problem.

In order to solve such a problem, it is considered that the partition wall made high. However, it leads to an increase of the height dimension of the terminal block, which is problematic.

SUMMARY

One or more embodiments provide a terminal block capable of preventing that a connection counterpart terminal is ridden on an upper end surface of a partition wall when the connection counterpart terminal attached in a terminal part of a wire is connected with a terminal of the terminal block, without increasing a height of the partition wall separating adjacent terminals to be insulated.

In an aspect (1), one or more embodiments provide a terminal block including a partition wall. The partition wall is erected between a plurality of terminals to separate the adjacent terminals to insulate. The partition wall includes an upper end surface and both side surfaces. Each of the both side surfaces includes a taper surface tilted downward and continuous to the upper end surface, and a vertical surface which is continuous to a lower side of the taper surface and positions a connection counterpart terminal to be connected with one of the plurality of terminal at a position of connection with the terminal.

In an aspect (2), the upper end surface has an arc-shaped apex which is continuous to the taper surfaces.

In an aspect (3), the terminal block includes a terminal block body made of a block-shaped insulation resin material and a plurality of terminals positioned in a predetermined position of the terminal block body.

In an aspect (4), the terminal is a plate-shaped conductive member bent to have a L-shaped lateral section.

In an aspect (5), the terminal block body includes a counterpart terminal attaching part in which a connection part of the connection counterpart terminal is connected to the terminal, and a support part supporting the counterpart terminal attaching part.

In the terminal block according to a first aspect of the invention, the taper surface which is tilted downward and continuous to the upper end surface of the partition wall and the vertical surface which is continuous to the lower side of the taper surface and positions the connection counterpart terminal to be connected with the terminal at the position of connection with the terminal are provided in the both side surfaces of the partition wall erected between the plurality of terminals to separate the adjacent terminals in an insulating manner. With such a configuration, when the connection counterpart terminal attached in the terminal part of the wire is connected with the terminal of the terminal block, although the connection counterpart terminal is ridden on the upper end surface of the partition wall, the connection counterpart terminal is not stabilized in the state of being ridden on the upper end surface, but is slid over the taper surface to be moved to the connection position determined by the vertical surface. For this reason, the terminal block according to the first aspect of the invention can prevent that the connection counterpart terminal is ridden on the upper end surface of the partition wall without increasing the height of the partition wall which separates the adjacent terminals in an insulating manner.

In the terminal block according to a second aspect to the invention, the partition wall has an arc-shaped apex of the upper end surface which is continuous to the taper surfaces formed in both side surfaces. Thus, the connection counterpart terminal is easily moved from the upper end surface having the arc-shaped apex to the taper surface. For this reason, the terminal block according to the second aspect of the invention can prevent more reliably that the connection counterpart terminal is ridden on the upper end surface of the partition wall.

FIGS. 1A and 1B are perspective views of a terminal block according to an embodiment of the invention. FIG. 1A is a view when viewed from a front side. FIG. 1B is a view when viewed from a back side.

Hereinafter, a proper embodiment of a terminal block according to the invention will be described in detail with reference to the drawings.

EMBODIMENT

Figure 1A:
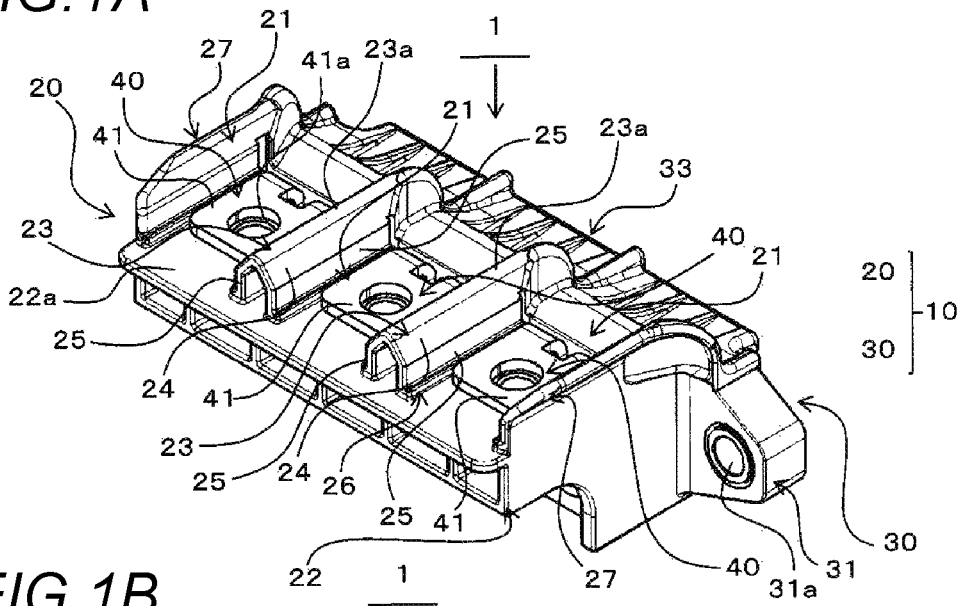
Figure 1B:
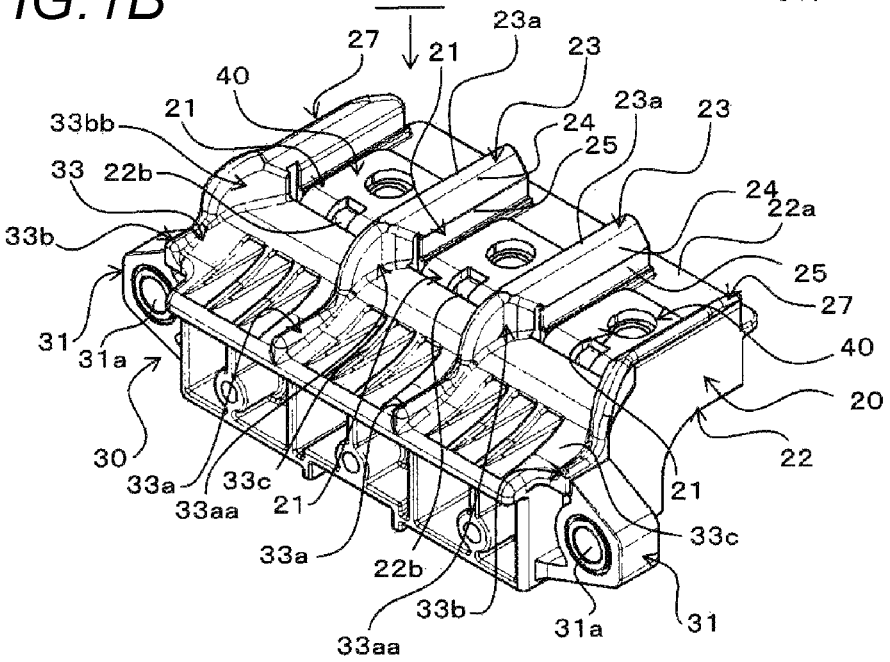
Figure 2:
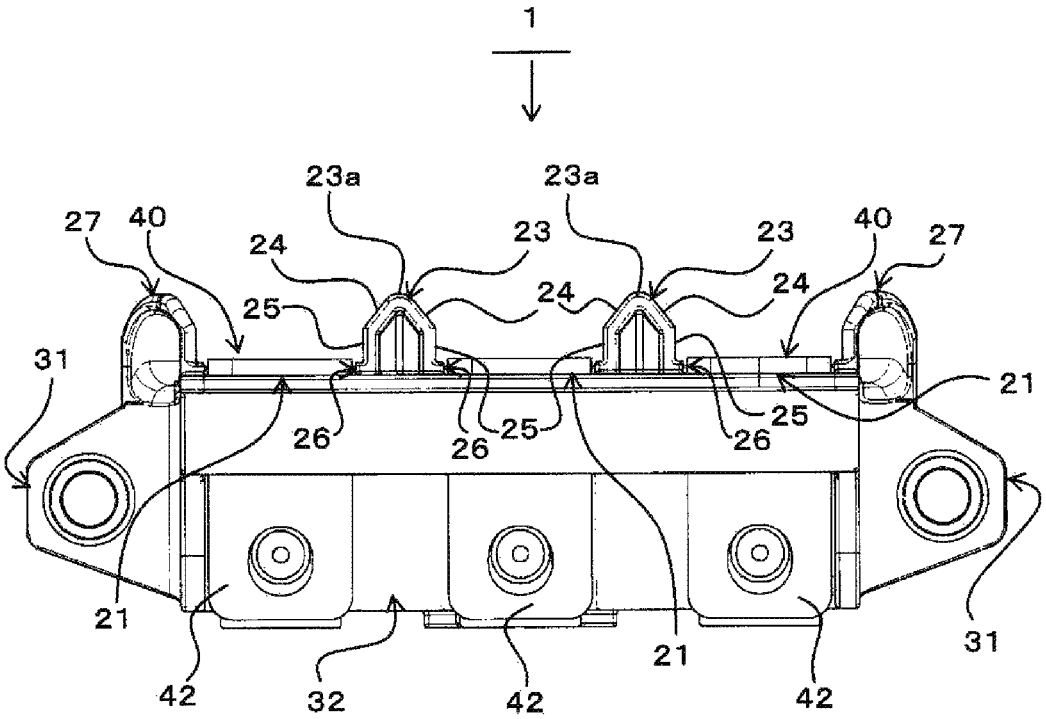
FIG. 2 is a front view of the terminal block.
Figure 3:
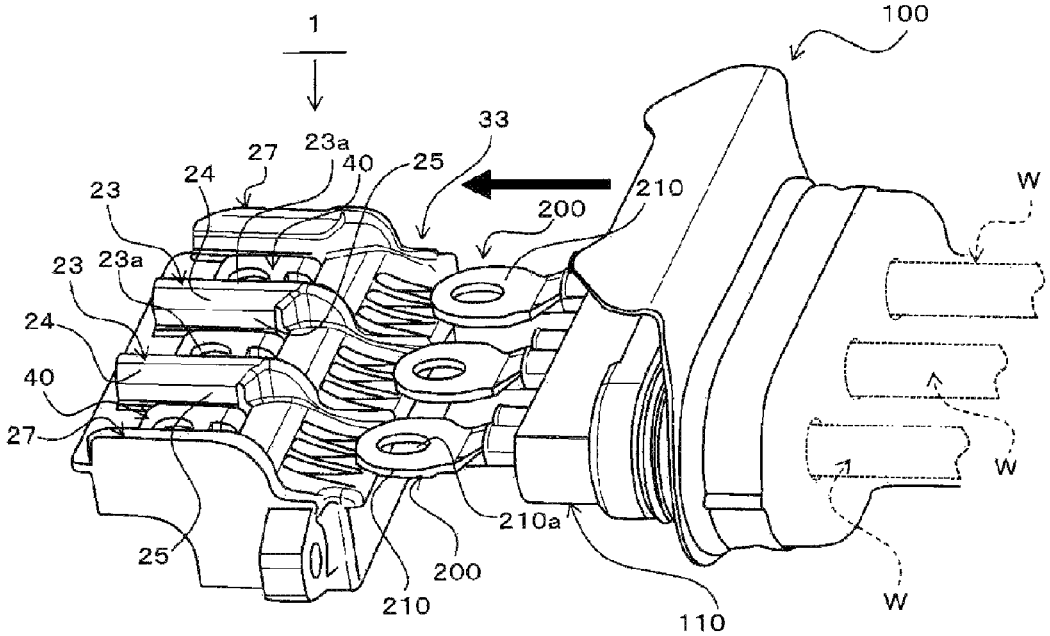
FIG. 3 is a view illustrating an aspect in which in order to connect a connection counterpart terminal of a connector with a terminal of the terminal block, the connector is moved from the back side of the terminal block toward the terminal block.
Figure 4:
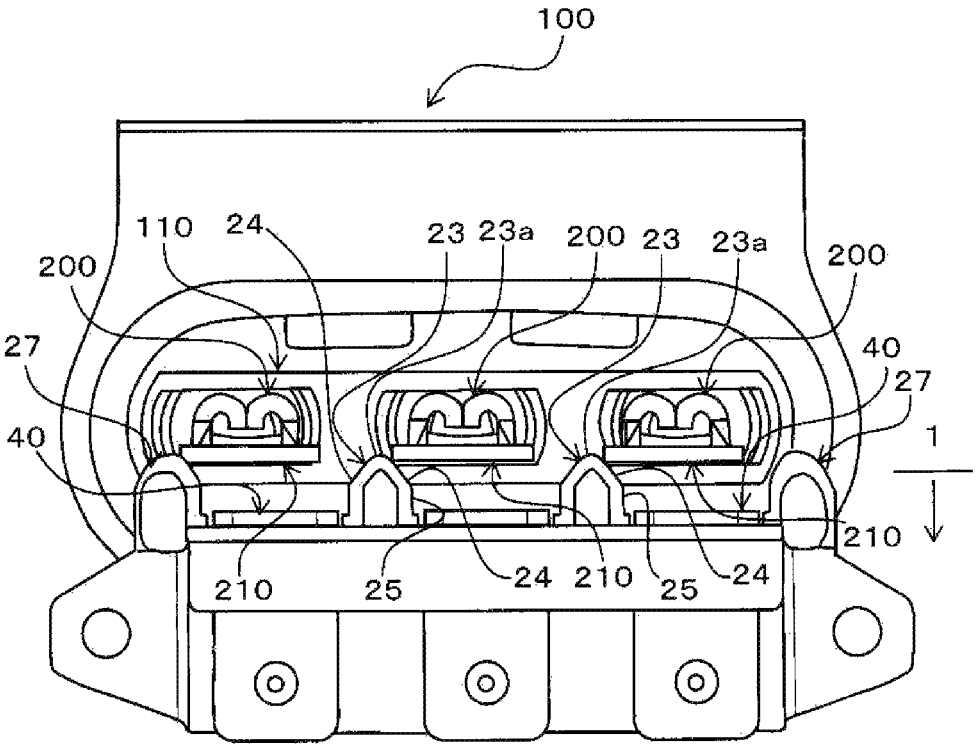
FIG. 4 is a view illustrating a state where the connection counterpart terminal is ridden on a taper surface when viewed from a front surface of the terminal block.
Figure 5:
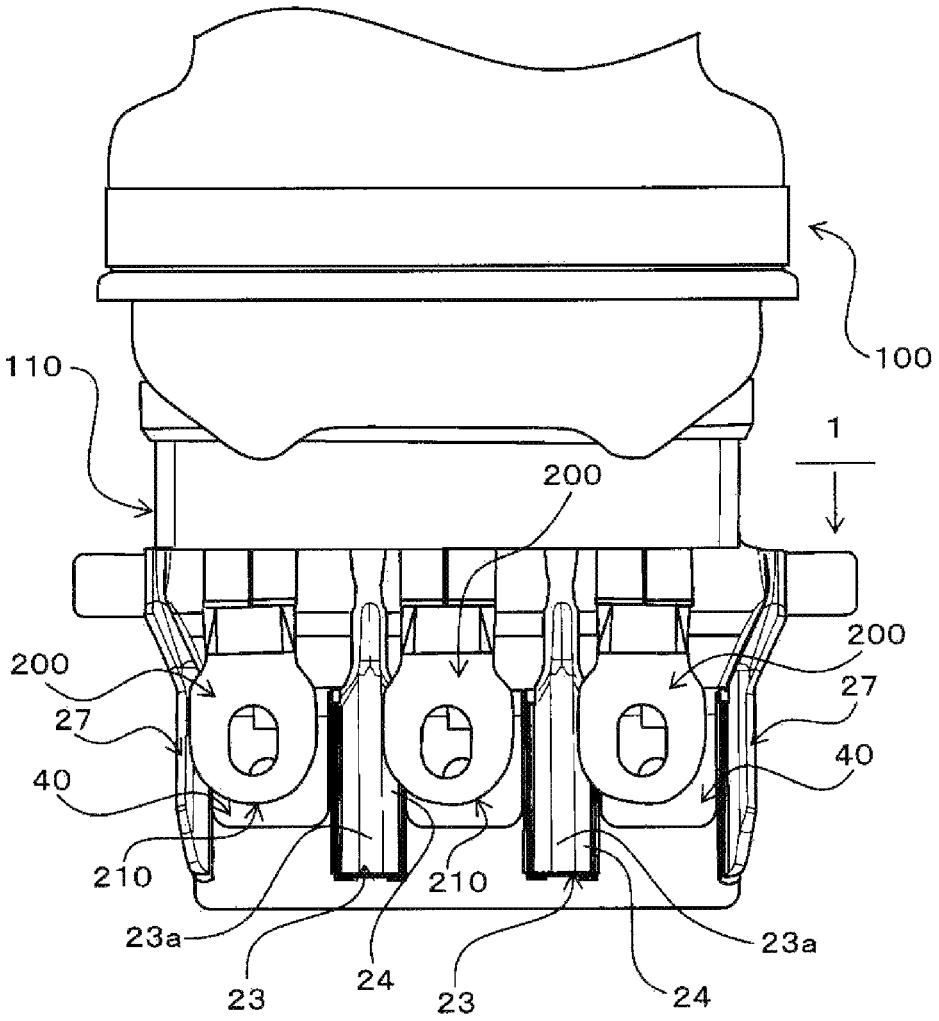
FIG. 5 is a view illustrating a state where the connection counterpart terminal is ridden on the taper surface when viewed from an upper surface of the terminal block.
Figure 6:
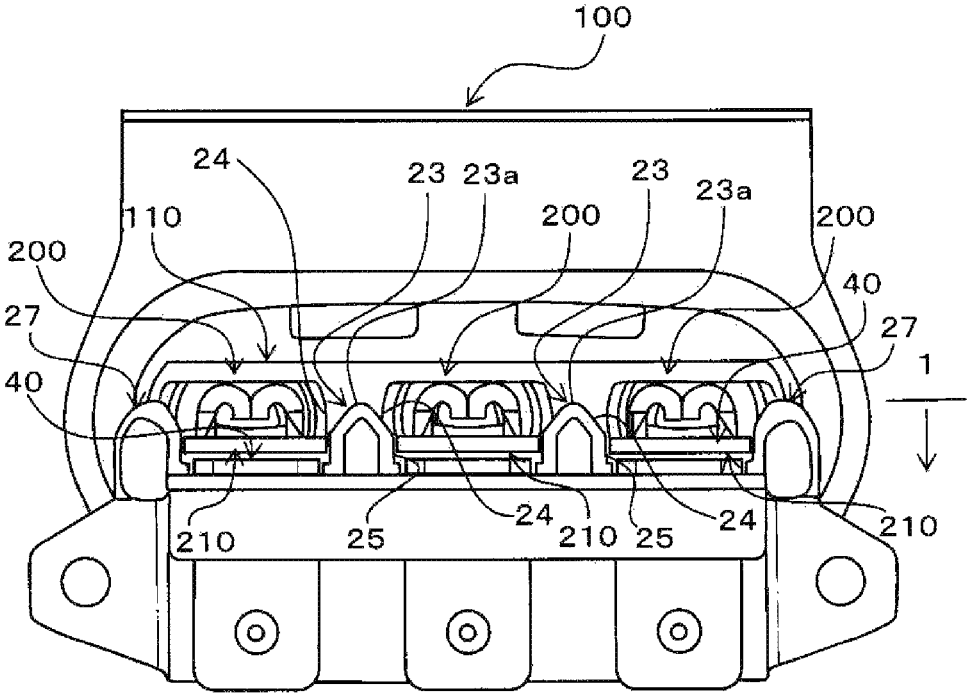
FIG. 6 is a view illustrating a state where the connection counterpart terminals are arranged in positions of connection with the corresponding terminals of the terminal block when viewed from the front surface of the terminal block.
Figure 7:
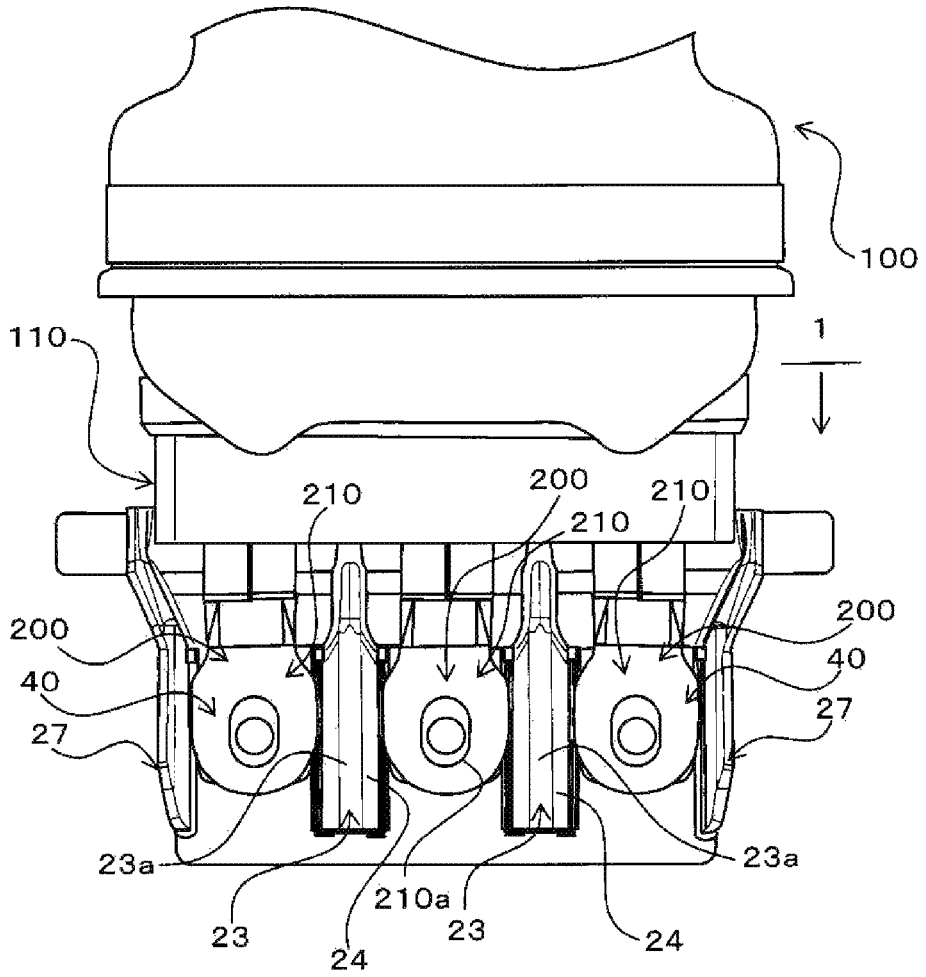
FIG. 7 is a view illustrating a state where the connection counterpart terminals are arranged in the positions of connection with the corresponding terminals of the terminal block when viewed from the upper surface of the terminal block.

FIGS. 1A and 1B are perspective views of a terminal block 1 according to an embodiment of the invention, wherein FIG. 1A is a view when viewed from a front side and FIG. 1B is a view when viewed from a back side. FIG. 2 is a front view of the terminal block 1. FIG. 3 is a view illustrating an aspect in which in order to connect a connection counterpart terminal 200 of a connector 100 with a terminal 40 of the terminal block 1, the connector 100 is moved from the back side of the terminal block 1 toward the terminal block 1. FIG. 4 is a view illustrating a state where the connection counterpart terminal 200 is ridden on a taper surface 24 when viewed from a front surface of the terminal block 1. FIG. 5 is a view illustrating a state where the connection counterpart terminal 200 is ridden on the taper surface 24 when viewed from an upper surface of the terminal block 1. FIG. 6 is a view illustrating a state where the connection counterpart terminals 200 are arranged in positions of connection with the corresponding terminals 40 of the terminal block 1 when viewed from the front surface of the terminal block 1. FIG. 7 is a view illustrating a state where the connection counterpart terminals 200 are arranged in the positions of connection with the corresponding terminals 40 of the terminal block 1 when viewed from the upper surface of the terminal block 1.

The terminal block 1 according to the embodiment of the invention is provided with three terminals 40 which are connected with the respective terminals 200 (hereinafter, referred to as "connection counterpart terminal" for distinguishment from the terminal of the terminal block) which are attached in terminal parts of three wires W held in a housing 110 of the connector 100.

Herein, the description will be given about the connector 100 connected in the terminal block 1.

Incidentally, the connector 100 is a connector which is generally used in the related art.

The connector 100 has the housing 110 which horizontally holds three wires W.

In each of the wires W, the connection counterpart terminal 200 to be connected with the terminal 40 of the terminal block 1 is attached in the terminal part, and a wire W portion near the connection counterpart terminal 200 is held in the housing 110 to be movable freely.

Since the wire W is held in the housing 110 such that the wire W portion near the connection counterpart terminal 200 is movable freely as described above, a portion of the connection counterpart terminal 200 to be connected with the terminal 40 of the terminal block 1 can be arranged in the connection position on the terminal block 1 to have a certain degree of freedom.

In the connection counterpart terminal 200, a bolt insertion hole 210*a* for bolt fastening is formed in a plate-shaped connection part 210 of the terminal of the terminal block 1.

Next, the terminal block 1 will be described.

The terminal block 1 includes a terminal block body 10 made of a block-shaped insulation resin material and three terminals 40 provided in a predetermined position of the terminal block body 10.

In the terminal 40, a plate-shaped conductive member is bent to have a L-shaped lateral section, one end part is a connection part 41 connected with the connection counterpart terminal 200, and the other end is a portion which is connected with an electrical wire (not illustrated) electrically connected with the connection counterpart terminal 200.

In the terminal 40, a bolt insertion hole 41*a* for bolt fastening is formed in the connection part 41.

The terminal block body 10 has a counterpart terminal attaching part 20 which is attached such that the connection part 210 of the connection counterpart terminal 200 is connected with the terminal 40, and a support part 30 for supporting the counterpart terminal attaching part 20.

In the counterpart terminal attaching part 20, the three terminals 40 are horizontally provided to correspond to three connection counterpart terminals 200 in a state where the connection part is exposed from the terminal block body 10, and partition walls 23 are erected between the connection parts 41 of the three terminals 40, and three terminal arranging parts 21 are provided which separate the connection parts 41 of the adjacent terminal 40 in an insulating manner.

The three terminal arranging parts 21 have a base part 22 formed with a terminal placement surface 22*a* on which the connection parts 41 of the three terminals 40 are mounted. The partition walls 23 are erected between the connection parts 41 of the three terminals 40 on the terminal placement surface 22*a*, so that the terminal arrangement parts 21 are partitioned on the terminal placement surface 22*a*.

In the three terminal arranging parts 21, a terminal arrangement part 21 right in the middle is arranged such that the connection part 41 of the terminal 40 is exposed from the terminal block body 10 between the lower end parts of the two partition walls 23.

In the three terminal arranging parts 21, the two terminal arrangement parts 21 of both ends are arranged such that the connection part 41 of the terminal 40 is exposed from the terminal block body 10 between the lower end part of the partition wall 23 and a lower end part of an end surrounding wall 27 erected in each of both end parts on the terminal placement surface 22*a*.

In the partition wall 23, the both side surfaces are provided with taper surfaces 24 which are tilted downward and continuous to the upper end surface 23*a* of the partition wall 23, vertical surfaces 25 which are continuous to the lower side of the taper surface 24 and position the connection counterpart terminals 200 at the positions of connection with the terminals 40, and terminal positioning parts 26 which protrude such that the terminal 40 is positioned in the lowest end part in which the terminal 40 is arranged.

The partition wall 23 is erected on the terminal placement surface 22*a* in a direction orthogonal to a parallel direction of the terminal 40 to extend from the front surface side of the terminal block 1 of the terminal placement surface 22*a* toward the back side.

The two partition walls 23 are arranged to provide a gap slightly larger than the width of the terminal 40.

The taper surface 24 is formed to be continuous to the end part of the front surface side of the partition wall 23 to the end part of the back side.

The partition wall 23 has the arc-shaped apex of the upper end surface 23 a which is continuous to the taper surfaces 24 formed in the both side surfaces.

That is, in the partition wall 23, the lateral sectional shape of the upper end part is a mountain shape, and the apex of the mountain has an arc shape.

For this reason, although the connection part 210 of the connection counterpart terminal 200 is ridden on the upper end surface 23*a*, since the connection part 210 is positioned in an unstable state in the state, the connection part 210 returns to the taper surface 24.

The vertical surface 25 is provided between the taper surface 24 and the terminal positioning part 26 in a height direction. A gap of the vertical surfaces 25 of the adjacent partition walls 23 is set to have a width slightly larger than the width of the connection part 210 of the connection counterpart terminal 200.

The terminal positioning part 26 is a portion protruding outward with respect to the vertical surface 25, and is set to have a thickness smaller than the thickness of the terminal 40 in the height direction.

A gap of the terminal positioning parts 26 of the adjacent partition walls 23 is set to have a width slightly larger than the width of the connection part 41 of the terminal 40.

For this reason, the terminal 40 is arranged to be positioned on the terminal placement surface 22*a* between the terminal positioning parts 26 of the adjacent partition walls 23.

Since the thickness of the terminal positioning part 26 is set to be smaller than the thickness of the terminal 40, the connection part 210 of the connection counterpart terminal 200 arranged to be positioned on the connection part 41 of the terminal 40 can be brought into surface contact with the connection part 41 of the terminal 40.

Next, the support part 30 will be described.

The support part 30 is a portion which is continuous to the back end part of the counterpart terminal attaching part 20 so as to extend downward with respect to the counterpart terminal attaching part 20.

The support part 30 has fixing parts 31 for fixing the terminal block 1 in a fixation tip, a terminal arrangement part 32 arranged in a state where the end parts 42 of the three terminals 40 on an opposite side to the connection part 41 connected with the connection counterpart terminal 200 are exposed, and three counterpart terminal induction parts 33 which induce the three connection counterpart terminals 200 to the three terminal arranging parts 21 of the counterpart terminal attaching part 20 respectively.

A pair of fixing parts 31 are provided in both side portions of the support part 30 to protrude outward, and a bolt insertion hole 31*a* into which the fixing bolt is inserted is formed in each of the fixing parts 31.

The terminal arrangement part 32 is arranged such that the end part on an opposite side to the connection parts of three terminals 40 which protrude to the back side of the terminal placement surface 22*a* is exposed through a slit 22*b* formed in the terminal placement surface 22*a* of the terminal arrangement parts 21 of the counterpart terminal attaching part 20.

In three counterpart terminal induction parts 33, the counterpart terminal induction part 33 right in the middle has two induction walls 33*a* which extend from the end parts of the back sides of the two adjacent partition walls 23 to the back surface of the terminal block body 10, and an induction surface 33*c* in which two induction walls 33*a* are erected and which is continuously in contact with the end part of the back side of the terminal placement surface 22*a* and is formed to be tilted gently downward toward the back surface of the terminal block body 10.

In three counterpart terminal induction parts 33, the two counterpart terminal induction parts 33 of both ends each have two induction walls 33*a* and 33*b* which extend from the end part of the back side of one partition wall 23 and the end surrounding wall 27 adjacent to the partition wall 23 to the back surface of the terminal block body 10, and the induction surface 33*c* in which the two induction walls 33*a* and 33*b* are erected and which is formed to be continuously contact with the end part of the back side of the terminal placement surface 22*a* and to be tilted gently downward toward the back surface of the terminal block body 10.

The induction walls 33*a* and 33*b* are formed as a thin wall thinner than the partition wall 23 and the end surrounding wall 27 from the end part of the back side of the terminal block body 10 to the vicinity of the part connected with the partition wall 23 and the end surrounding wall 27. The part connected with the partition wall 23 and the end surrounding wall 27 are formed as curved connection surfaces 33*aa* and 33*bb*, so as to be smoothly connected to the partition wall 23 and the end surrounding wall 27.

For this reason, the induction wall 33*a* is formed such that the connection counterpart terminal 200 can be smoothly induced by the curved connection surface 33*aa* from the end part of the back side of the terminal block body 10 to the taper surface 24 of the partition wall 23 and the vertical surface 25.

That is, the induction wall 33*a* is formed such that the connection counterpart terminal 200 is inducible onto the taper surface 24 without preventing that the connection counterpart terminal 200 is ridden on the taper surface 24.

Next, the description will be given about a process to connect the connection counterpart terminals 200 attached in the terminal parts of three wires W held in the housing 110 of the connector 100 with the respective corresponding terminals 40 of the terminal block 1, and the operation of each of the parts.

First, as illustrated in FIG. 3, an operator starts the connector 100 moving from the back side of the terminal block 1 toward the position completely connected with the terminal block 1.

Herein, since the connection counterpart terminal 200 is drawn from the housing 110 together with the terminal part of the wire W, the connection counterpart terminal 200 is freely movable together with the peripheral wire W portion.

Further, in a case where the connector 100 is moved toward the terminal block 1 from the position which is deviated downward with respect to the terminal block 1, the connection counterpart terminals 200 are induced by the counterpart terminal induction parts 33 toward the correspond terminal arrangement parts 21.

In a case where the connector 100 approaches the terminal block 1 until the connection counterpart terminal 200 is positioned in the partition wall 23 of the terminal block 1, and is positioned to be deviated with respect to the terminal block 1 in the lateral direction, as illustrated in FIGS. 4 and 5, the connection part 210 of the connection counterpart terminal 200 is ridden on the taper surface 24.

Thereafter, as illustrated in FIGS. 6 and 7, when the operator moves the connector 100 to the position completely connected with the terminal block 1, the connection counterpart terminal 200 ridden on the taper surface 24 is moved to the position of connection with the corresponding terminal 40.

Specifically, a force of returning to the position of the wire W portion held in the housing 110 acts on the wire W portion near the connection counterpart terminal 200 moving freely, so that the connection part 210 of the connection counterpart terminal 200 slides from the taper surface 24 toward the vertical surface 25 and finally is moved to the position of connection with the terminal 40.

Finally, the operator completes the operation which connects the connection counterpart terminal 200 with the corresponding terminal 40 of the terminal block 1 by bolt-fastening the connection counterpart terminal 200 and the terminal 40.

In the operation, even in a case where the connection counterpart terminal 200 is moved from the direction which is deviated with respect to the position of connection with the terminal 40, that is, the connection counterpart terminal 200 is moved toward the connection position in the state of being easily ridden on the upper end surface 23*a* of the partition wall 23, the connection counterpart terminal 200 is moved to the position of connection with the corresponding terminal 40.

In the terminal block 1 according to the embodiment of the invention, the both side surfaces of the partition walls 23 which are erected between the three terminals 40 to separate the adjacent terminal 40 in an insulating manner are each provided with the taper surface 24 which is tilted downward to be continuous to the upper end surface 23*a* of the partition wall 23, and the vertical surface 25 which is continuous to the lower side of the taper surface 24 and positions the connection counterpart terminal 200 connected in the terminal 40 at the position of connection with the terminal 40. With such a configuration, when the connection counterpart terminal 200 attached in the terminal part of the wire W is connected with the terminal 40 of the terminal block 1, although the connection counterpart terminal 200 is ridden on the upper end surface 23*a* of the partition wall 23, the connection counterpart terminal 200 is not stabilized in the state of being ridden on the upper end surface 23*a*, but is slid on the taper surface 24 and to be moved to the connection position determined by the vertical surface 25. For this reason, the terminal block 1 according to a first aspect of the invention can prevent that the connection counterpart terminal 200 is ridden on the upper end surface 23*a* of the partition wall 23 without increasing the height of the partition wall 23 which separates the adjacent terminals 40 in an insulating manner.

In the terminal block 1 according to the embodiment of the invention, the partition wall 23 has the arc-shaped apex of the upper end surface 23 *a* which is continuous to the taper surfaces 24 formed in the both side surfaces. Thus, the connection counterpart terminal 200 is easily moved from the upper end surface 23 *a* having the arc-shaped apex to the taper surface 24. For this reason, the terminal block 1 according to a second aspect of the invention can prevent more reliably that the connection counterpart terminal 200 is ridden on the upper end surface 23 *a* of the partition wall 23.

The terminal block 1 according to the embodiment of the invention is exemplarily illustrated to have the three terminals 40. However, the number of the terminals 40 is not limited, and the terminal block 1 may have a plurality of terminals 40.

Hereinbefore, the invention made by the inventors has been concretely described based on the above-described embodiment. However, the invention is not limited to the above-described embodiment, and various modifications can be made within the scope of the invention.

DESCRIPTION OF REFERENCE NUMERALS AND SIGNS

1: Terminal block
10: Terminal block body
20: Counterpart terminal attaching part
21: Terminal arranging part
22: Base part
22*a*: Terminal placement surface
22*b*: Slit
23: Partition wall
23*a*: Upper end surface
24: Taper surface
25: Vertical surface
26: Terminal positioning part

What is claimed is:

1. A terminal block comprising:

a partition wall, wherein the partition wall is erected between a plurality of terminals to separate the adjacent terminals to insulate, wherein the partition wall includes an upper end surface and both side surfaces, wherein each of the both side surfaces includes a taper surface tilted downward and continuous to the upper end surface, and a vertical surface which is continuous to a lower side of the taper surface and positions a connection counterpart terminal to be connected with one of the plurality of terminal at a position of connection with the terminal, wherein the taper surface is uniformly flat, and wherein the upper end surface has an arc-shaped apex which is continuous to the taper surfaces.

2. The terminal block according to claim 1, wherein the terminal block includes a terminal block body made of a block-shaped insulation resin material and a plurality of terminals positioned in a predetermined position of the terminal block body.

3. The terminal block according to claim 1, wherein the terminal is a plate-shaped conductive member bent to have a L-shaped lateral section.

4. The terminal block according to claim 1, wherein the terminal block body includes a counterpart terminal attaching part in which a connection part of the connection counterpart terminal is connected to the terminal, and a support part supporting the counterpart terminal attaching part.

* * * * *